US007886444B2

(12) United States Patent
Kao

(10) Patent No.: US 7,886,444 B2
(45) Date of Patent: Feb. 15, 2011

(54) FOLDABLE KNIFE HAVING SWITCH ELEMENT

(76) Inventor: Chih-Chen Kao, No. 109, Jhonghua Rd., Taoyuan City, Taoyuan County (TW)

( * ) Notice: Subject to any disclaimer, the term of this patent is extended or adjusted under 35 U.S.C. 154(b) by 295 days.

(21) Appl. No.: 12/071,950

(22) Filed: Feb. 28, 2008

(65) Prior Publication Data

US 2009/0183374 A1 Jul. 23, 2009

(30) Foreign Application Priority Data

Jan. 23, 2008 (TW) ..... 97201446 U

(51) Int. Cl.
*B26B 1/02* (2006.01)

(52) U.S. Cl. ..... 30/160; 30/159

(58) Field of Classification Search ..... 30/155, 30/156, 157, 158, 160, 161
See application file for complete search history.

(56) References Cited

U.S. PATENT DOCUMENTS 533,219 A * 1/1895 Hardy ..... 30/158
7,165,329 B2 * 1/2007 Kao ..... 30/161
7,313,866 B2 * 1/2008 Linn et al. ..... 30/159
7,437,822 B2 * 10/2008 Flagg et al. ..... 30/161
2003/0140500 A1 * 7/2003 Cheng ..... 30/159
2006/0260137 A1 * 11/2006 Flagg et al. ..... 30/160
2006/0272158 A1 * 12/2006 Williams ..... 30/161
2006/0288585 A1 * 12/2006 Kao ..... 30/159
2008/0201953 A1 * 8/2008 Bremer et al. ..... 30/1
2008/0276463 A1 * 11/2008 Kao ..... 30/155
2009/0126200 A1 * 5/2009 Kao ..... 30/159
2009/0144985 A1 * 6/2009 Liu ..... 30/158
2009/0144986 A1 * 6/2009 Frazer ..... 30/159

* cited by examiner

*Primary Examiner*—Hwei-Siu C Payer
(74) *Attorney, Agent, or Firm*—Bacon & Thomas, PLLC

(57) ABSTRACT

A foldable knife comprises a blade having an end pivotally connected to an end of a handle, and a spring having two ends connected to the handle and blade respectively, so that the spring can apply a torque to the blade to rotate the blade out of the handle. A blocking element is provided at an inner portion of the handle. A switch element pivotally connected to the inner portion of the handle has a first end extended out of the handle. When the blade is completely received in the handle, a second end of the switch element bears against the blade. When the user pushes the first end of the switch element, a positioning portion formed on the blocking element is disengaged from an engaging portion formed on the blade, so that the torque of the spring drives the blade to spring out of the handle.

9 Claims, 10 Drawing Sheets

A-A

B-B

FOLDABLE KNIFE HAVING SWITCH ELEMENT

FIELD OF THE INVENTION

The present invention relates to a foldable knife, and more particularly to a foldable knife having a switch element.

BACKGROUND OF THE INVENTION

Presently, a traditional foldable knife generally comprises a handle and a blade, wherein the blade has an end pivotally connected to an end of the handle. Thus, the blade can be rotated in relation to a pivot portion thereof until the blade is rotated out of the handle for use. Alternatively, the blade also can be rotated into the handle and received therein. When a user wants to use the traditional foldable knife, the user must hold the handle in one hand and draw the blade with the other hand, so as to rotate the blade out of the handle. However, a major disadvantage of the traditional foldable knife is that the user must use both hands to rotate the blade out of the handle. If a particular or emergent condition happens and the user only has one free hand to use, the user cannot speedily use the traditional foldable knife to deal with the particular or emergent condition. For example, when a fisherman is diving and has one hand entangled by a fishnet, the fisherman cannot speedily use the traditional foldable knife to cut the fishnet, resulting in a serious risk to the fisherman's life.

Referring now to FIG. 1, another traditional foldable knife is designed to solve the foregoing problem, wherein the traditional foldable knife comprises a handle 10 and a blade 11. The handle 10 is used to receive the blade 11. The blade 11 has a side formed with a knife edge 111 and an end pivotally connected to a first end of the handle 10 by a pivot 12, so that the blade 11 can be rotated into or out of the handle 10 in relation to the pivot 12. The handle 10 is provided with an elastic member 13 therein. The elastic member 13 has a first end positioned on a portion of the handle 10 adjacent to a second end of the handle 10, while the elastic member 13 has a second end extended to and positioned on a portion of the blade 11 adjacent to the pivot 12. When the blade 11 is completely received in the handle 10, the elastic member 13 biases the blade 11 with a torque to rotate the blade 11 into the handle 10, so that the blade 11 is stably kept in the handle 10. When the blade 11 is forced to be rotated out of the handle 10 to a predetermined angle, the elastic member 13 biases the blade 11 with a torque to rotate the blade 11 out of the handle 10, so that the blade 11 automatically springs out of the handle 10.

In order for the user to conveniently operate the traditional foldable knife, the knife edge 111 of the blade 11 is formed with a protrusion 112 at an end thereof adjacent to the pivot 12. When the blade 11 is completely received in the handle 10, the protrusion 112 will pass through a side of the handle 10 opposite to the blade 11 and protrude out of the handle 10. Hence, a height and a size of the protrusion 112 must be carefully designed so that the user can conveniently press the protrusion 112 in order to force the blade 11 to be rotated out of the handle 10 at least to the predetermined angle, allowing the elastic member 13 to bias the blade 11 with the torque to rotate the blade 11 out of the handle 10, so that the blade 11 can automatically spring out of the handle 10. However, because the blade 11 of the traditional foldable knife must be formed with the protrusion 112 having a considerable height and size, the structure of the protrusion 112 may lower the design aesthetics of the traditional foldable knife. Moreover, the protrusion 112 passes through a back side of the handle 10 where the user needs to hold firmly. Thus, if the user wants to hold the handle 10 in one hand and use the same hand to press the protrusion 112 for the blade 11 to automatically spring out of the handle 10, the user must adjust his or her holding area on the handle 10 considerably to make room for the thumb or the index finger of the same hand to press the protrusion 112. However, it is inconvenient for the user to execute the foregoing operation, and the traditional foldable knife may drop from the hand of the user if the user cannot stably hold the handle 10 with only one hand. If a particular or emergent condition happens and the user only has one free hand to use, the user still cannot use the traditional foldable knife speedily or smoothly to deal with the particular or emergent condition.

In view of the above, designers and manufacturers of foldable knives must design a foldable knife not only to satisfy functional needs but also incorporate a human-based design, so that the foldable knife is enhanced in operational convenience and safety. Therefore, it is important to develop a safe and convenient foldable knife for users to operate easily.

It is therefore tried by the inventor to develop a foldable knife having a switch element to solve the problems with the traditional foldable knife as described above.

SUMMARY OF THE INVENTION

A primary object of the present invention is to provide a foldable knife, which foldable knife comprises a handle, a blade, a spring, a blocking portion, and a poking element, wherein the handle has a receiving space, and the blade has an end pivotally connected to an end of the handle by a pivot. The pivot is mounted with the spring, which has two ends connected to the handle and the blade, respectively, so that the spring can bias the blade with a torque to rotate the blade out of the handle. The blocking element is provided at an inner portion of the handle adjacent to the pivot. When the blade has sprung completely out of the handle, the blocking element is engaged with the end of the blade, so as to prevent the blade from being rotated and received in the receiving space of the handle. When the blocking element is forced and moved away from an engaged position where the blocking element is engaged with the blade, the blade is released for being rotated, so that the blade can be completely received in the handle. The blocking element is formed with a positioning portion, while the blade is formed with an engaging portion. When the blade is completely received in the handle, the engaging portion is engaged with the positioning portion, so that the blade can be stably received and positioned in the handle.

A secondary object of the present invention is to provide a foldable knife having a poking element, so as to enhance the operational convenience and safety of the foldable knife. The poking element is pivotally connected to an inner portion of the handle, and has a first end extended out of the handle for being pushed by a user. When the blade is completely received in the handle, a second end of the poking element bears against the blade. Thus, when the user pushes the first end of the poking element, the positioning portion can be disengaged from the engaging portion. Meanwhile, the torque of the spring drives the blade to spring out of the handle. Therefore, while holding the handle stably in one hand, a user can use a finger of the same hand to push the poking element, so that the blade will spring automatically out of the handle without the user having to substantially adjust a holding area on the handle. As a result, the operational convenience and safety of the foldable knife is greatly enhanced, allowing the user to use the foldable knife speedily or smoothly to deal with a particular or emergent condition.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
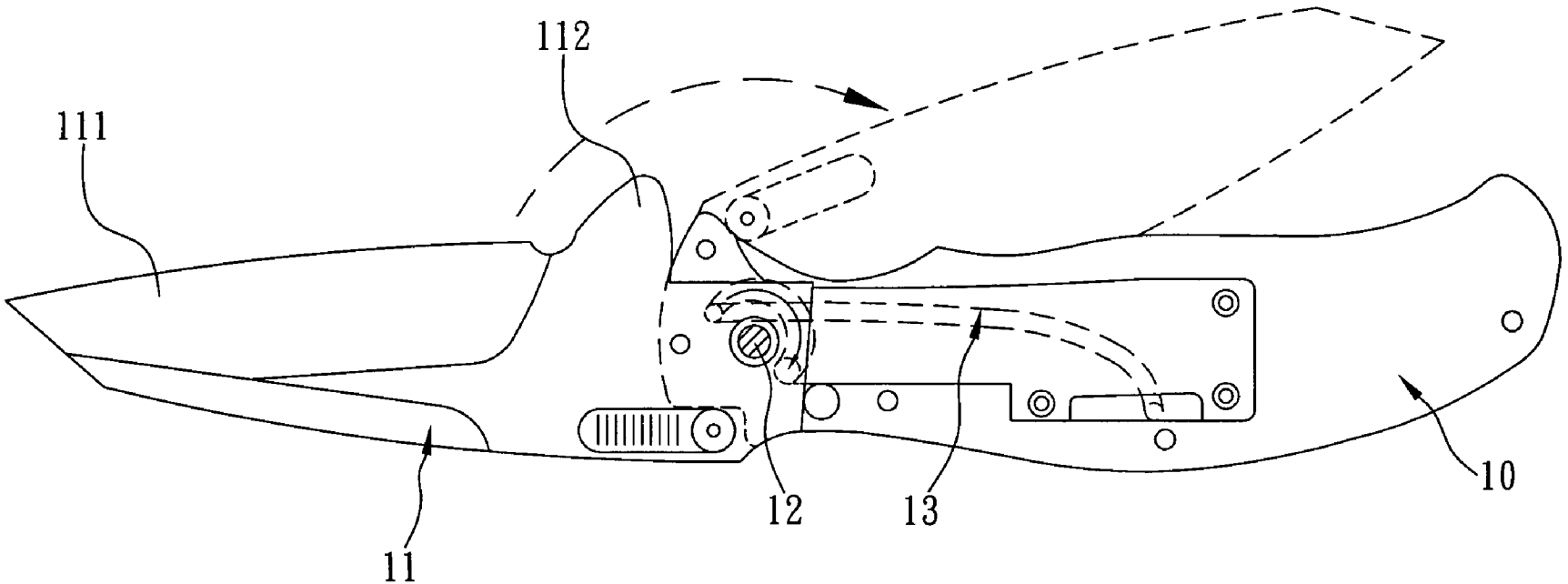
FIG. 1 (Prior Art)
FIG. 1 is a cross-sectional view of a traditional foldable knife.
Figure 2:
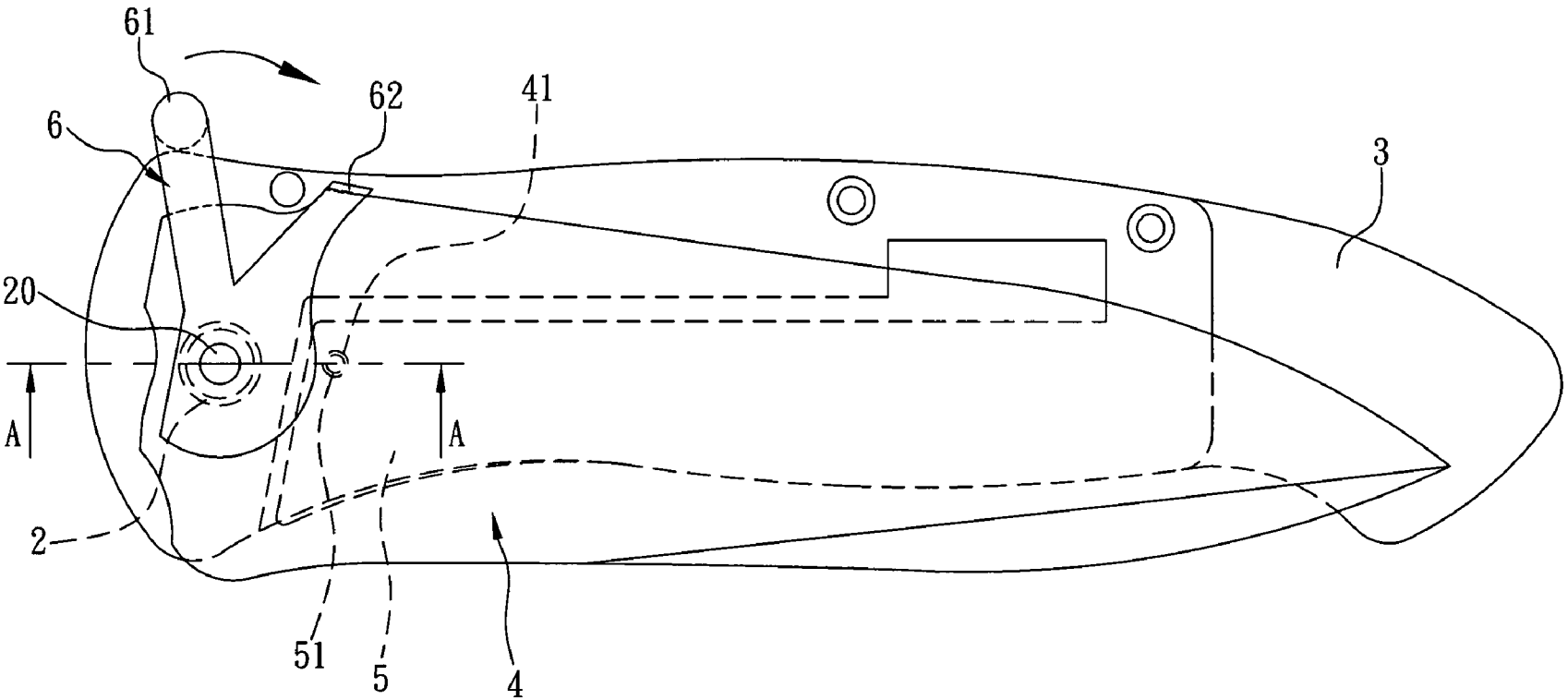
FIG. 2 is a cross-sectional view of a foldable knife according to a first preferred embodiment of the present invention in a status where a blade is received in a handle.
Figure 3:
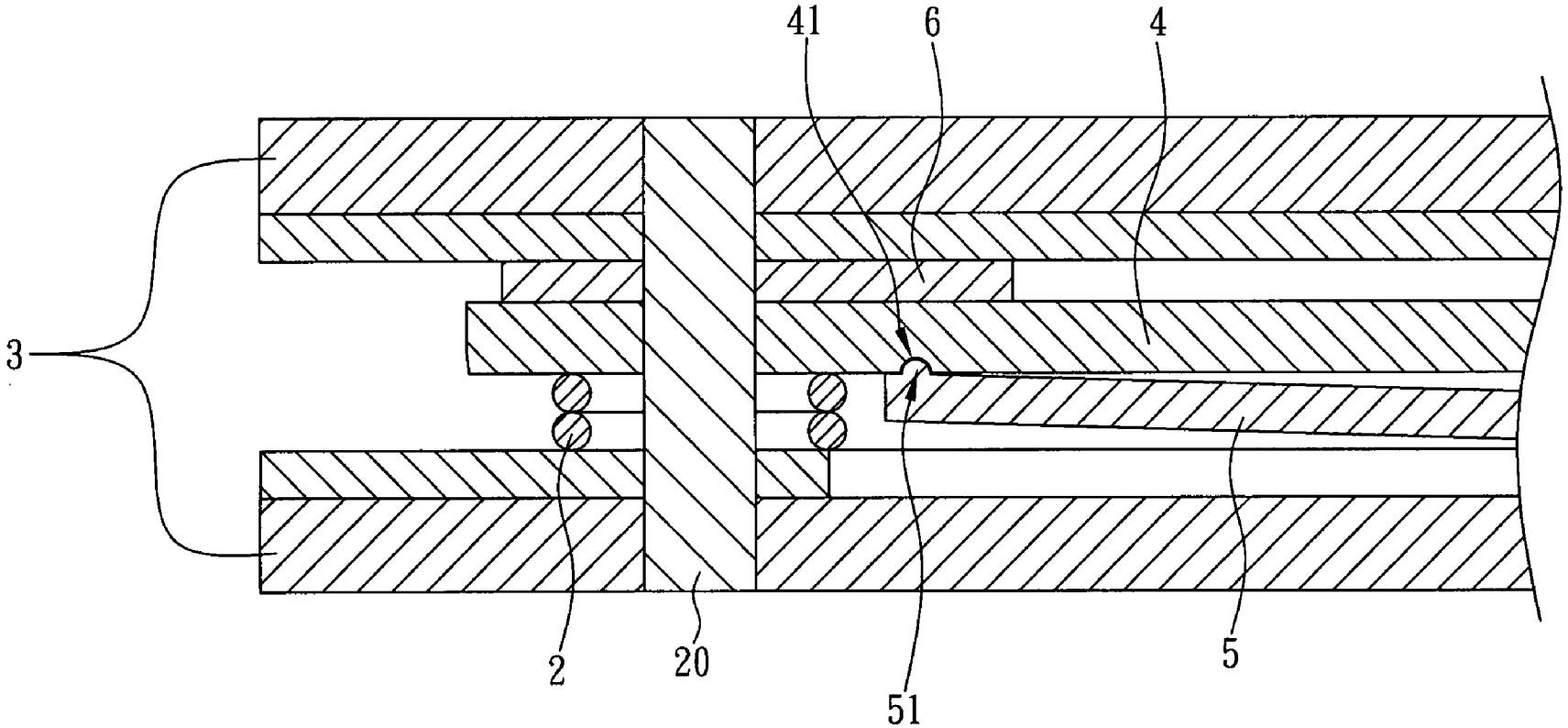
FIG. 3 is a cross-sectional view of the foldable knife according to the first preferred embodiment of the present invention, taken along a line A-A in FIG. 2.
Figure 4:
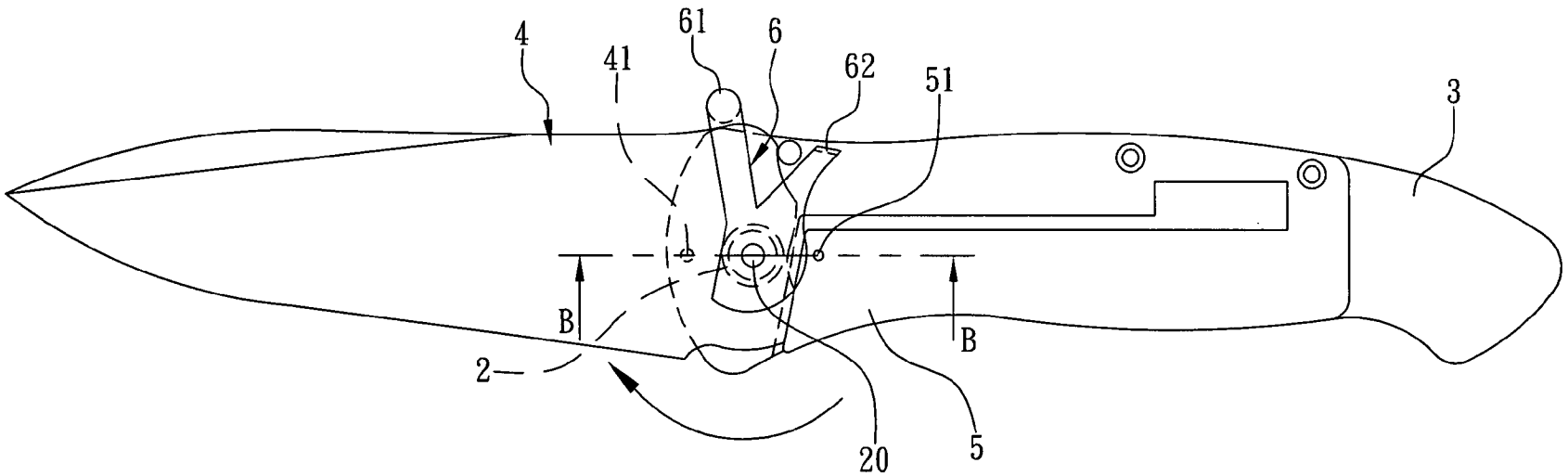
FIG. 4 is a cross-sectional view of the foldable knife according to the first preferred embodiment of the present invention in a status where the blade is released out of the handle.
Figure 5:
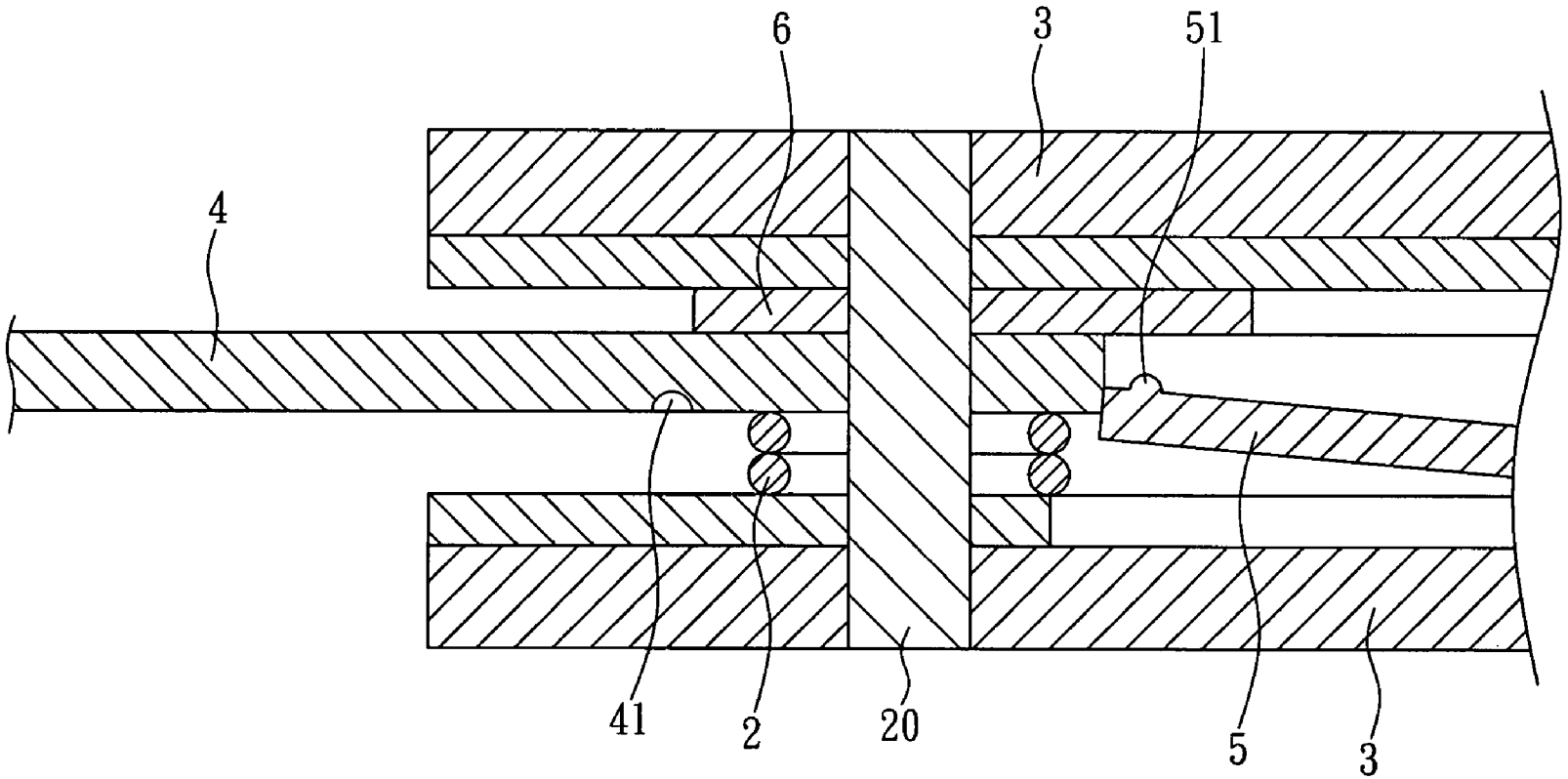
FIG. 5 is a cross-sectional view of the foldable knife according to the first preferred embodiment of the present invention, taken along a line B-B in FIG. 4.

Referring now to FIGS. 2 and 3, where a foldable knife having a poking element according to a first preferred embodiment of the present invention is illustrated. As shown, the foldable knife comprises a torsion spring 2, a handle 3, a blade 4, a blocking element 5, and a poking element 6, wherein the handle 3 is a hollow structure, and the blade 4 has an end pivotally connected to an end of the handle 3 by a pivot 20. Thus, the blade 4 can be rotated out of the handle 3 in relation to a central axis defined by the pivot 20 so that the blade 4 can be used to cut an article. Or alternatively, the blade 4 can be rotated into the handle 3 and received therein for reducing the volume of the foldable knife for easy carriage and preventing the blade 4 from endangering a user or some other articles. The pivot 20 is mounted with the torsion spring 2, which has a first end connected to a portion of the handle 3 adjacent to the pivot 20 and a second end connected to a portion of the blade 4 adjacent to the pivot 20. Thus, the torsion spring 2 can bias the blade 4 with a torque to rotate the blade 4 out of the handle 3. The blocking element 5 is provided at an inner portion of the handle 3 adjacent to the pivot 20. Referring now to FIGS. 4 and 5, when the blade 4 has sprung completely out of the handle 3, the blocking element 5 is engaged with the end of the blade 4, so as to prevent the blade 4 from being rotated and received in the handle 3. When the blocking element 5 is forced and moved away from an engaged position where the blocking element 5 is engaged with the blade 4, the blade 4 is released for being rotated, so that the blade 4 can be completely received in the handle 3. The blocking element 5 is formed with a positioning portion 51 (such as a steel ball or a protrusion), while the blade 4 is formed with an engaging portion 41 (such as a recess). When the blade 4 is completely received in the handle 3, the engaging portion 41 is engaged with the positioning portion 51, so that the blade 4 is stably received and positioned in the handle 3. Furthermore, the poking element 6 is pivotally connected to where the handle 3 and the blade 4 are pivotally connected to each other. The poking element 6 has a first end extended out of the handle 3 for being pushed by the user. When the blade 4 is completely received in the handle 3, a second end of the poking element 6 bears against the blade 4. Thus, when the user pushes the first end of the poking element 6, the second end of the poking element 6 forces the blade 4 to rotate the blade 4 out of the handle 3. When the positioning portion 51 is disengaged from the engaging portion 41, the torque of the torsion spring 2 can drive the blade 4 to spring out of the handle 3.

Figure 7:
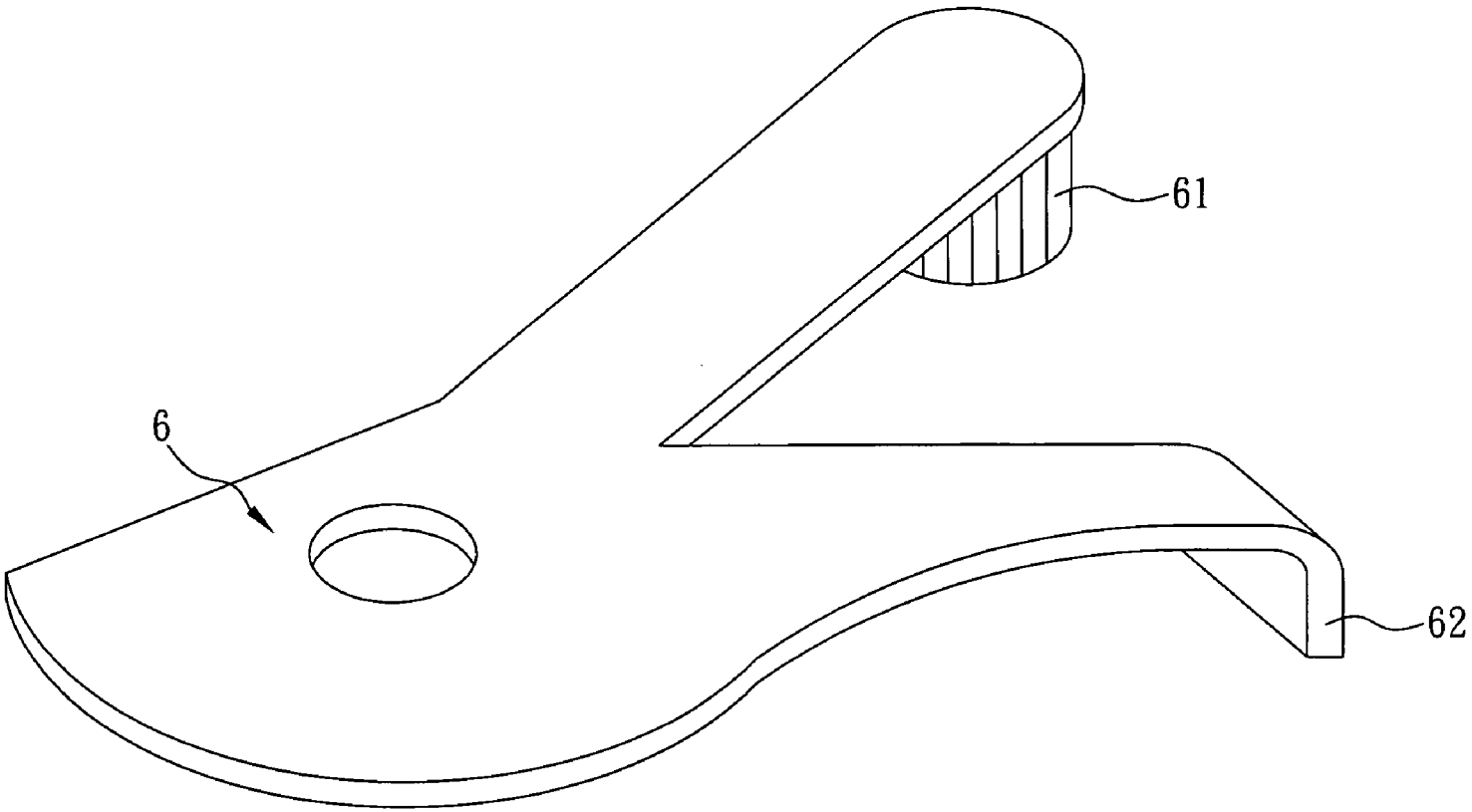
FIG. 7 is a perspective view of a switch element according to the first preferred embodiment of the present invention.

Referring now to FIG. 7, in the first preferred embodiment of the present invention, the poking element 6 is a sheet structure, wherein the first end thereof is extended out of the handle 3 and formed with a protruding poking portion 61 for being pushed by the user while the second end of the poking element 6 is formed with a pressing portion 62. Referring back to FIG. 2, when the blade 4 is completely received in the handle 3, the pressing portion 62 bears against the blade 4. As a result, when the user pushes the protruding poking portion 61, the poking element 6 can be rotated while the pressing portion 62 forces the blade 4 to rotate out of the handle 3. Referring to FIGS. 2 and 3, the blocking element 5 is an elastic sheet structure, and has a side surface which is close to the blade 4 and formed with the positioning portion 51. When the blade 4 is completely received in the handle 3, the blocking element 5 is tightly in contact with the blade 4 due to an elastic force of the blocking element 5. Thus, the engaging portion 41 is engaged with the positioning portion 51, so that the blade 4 is stably received and positioned in the handle 3. When the user pushes the protruding poking portion 61, the pressing portion 62 is actuated to apply a force to the blade 4. This force is transmitted to the blade 4, driving the blade 4 to rotate and apply a force to the blocking element 5. When the force from the blade 4 is enough to push the blocking element 5 away and disengage the positioning portion 51 from the engaging portion 41, the torque of the torsion spring 2 will drive the blade 4 to spring out of the handle 3. Referring to FIGS. 4 and 5, when the blade 4 has sprung completely out of the handle 3, the blocking element 5 is engaged with the end of the blade 4 due to the elastic force of the blocking element 5, so as to prevent the blade 4 from being rotated and received in the handle 3. As a result, the user can hold the handle 3 firmly in one hand, and use a finger of the same hand to simultaneously push the protruding poking portion 61 of the poking element 6, thereby driving the blade 4 to spring out of the handle 3 rapidly and smoothly. Thus, the operational convenience and safety of the foldable knife is effectively enhanced even when a particular or emergent condition happens and the user only has one free hand to use.

Figure 6:
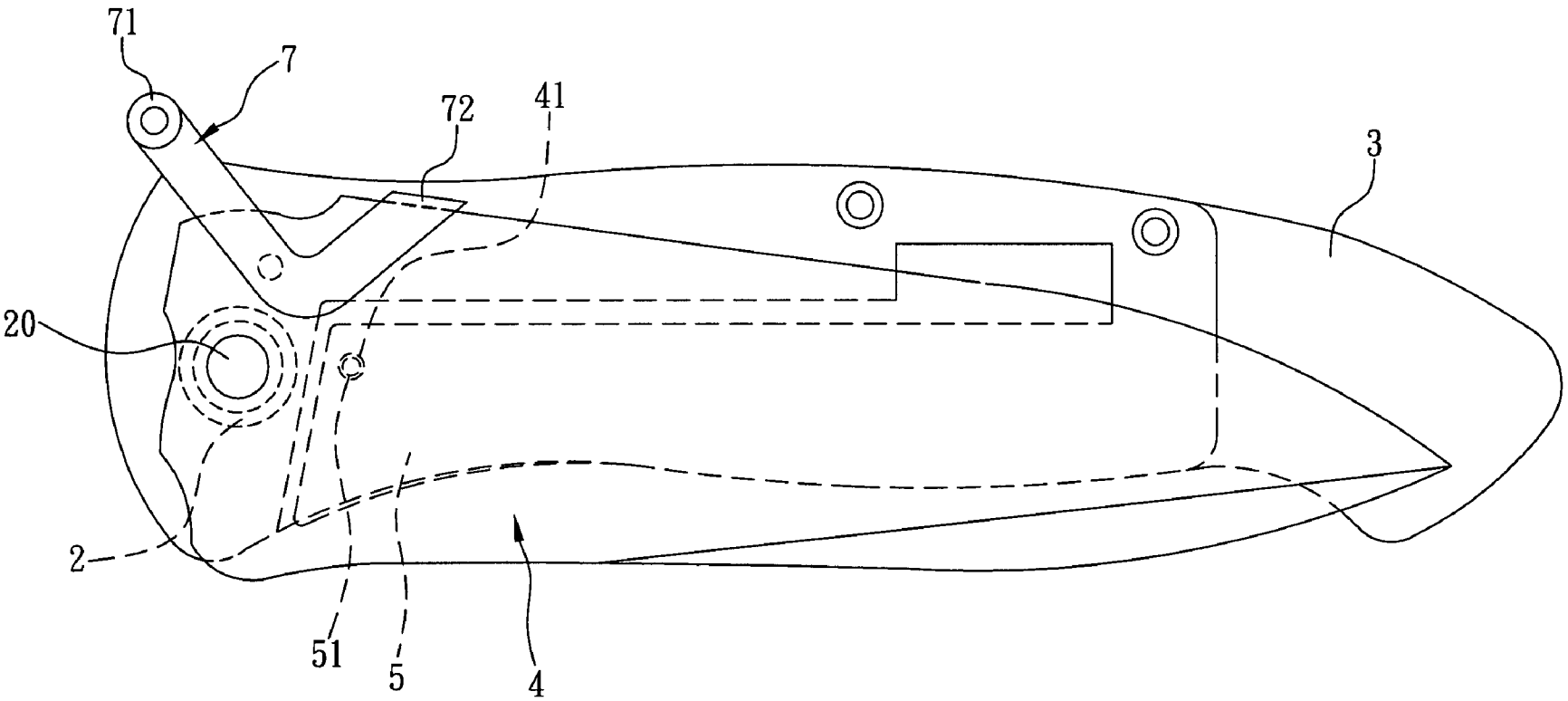
FIG. 6 is a cross-sectional view of a foldable knife according to a second preferred embodiment of the present invention in a status where a blade is received in a handle.

Referring now to FIG. 6, in a second preferred embodiment of the present invention, a poking element 7 is pivotally connected to an inner portion of the handle 3 adjacent to the pivot 20. The poking element 7 has a first end extended out of the handle 3 and formed with a protruding poking portion 71 for being pushed by the user. The poking element 7 also has a second end formed with a pressing portion 72 which bears against the blade 4 when the blade 4 is completely received in the handle 3. As a result, when the user pushes the protruding poking portion 71, the poking element 7 can be rotated, driving the pressing portion 72 to apply a force to the blade 4 and thereby rotate the blade 4 out of the handle 3. When the blade 4 is rotated to disengage the positioning portion 51 from the engaging portion 41, the torque of the torsion spring 2 can drive the blade 4 to spring out of the handle 3. When the blade 4 has sprung completely out of the handle 3, the blocking element 5 is engaged with the end of the blade 4, so as to prevent the blade 4 from being rotated and received in the handle 3. When the blocking element 5 is forced and moved away from an engaged position where the blocking element 5 is engaged with the blade 4, the blade 4 is released for being rotated, and can be completely received in the handle 3.

Figure 8:
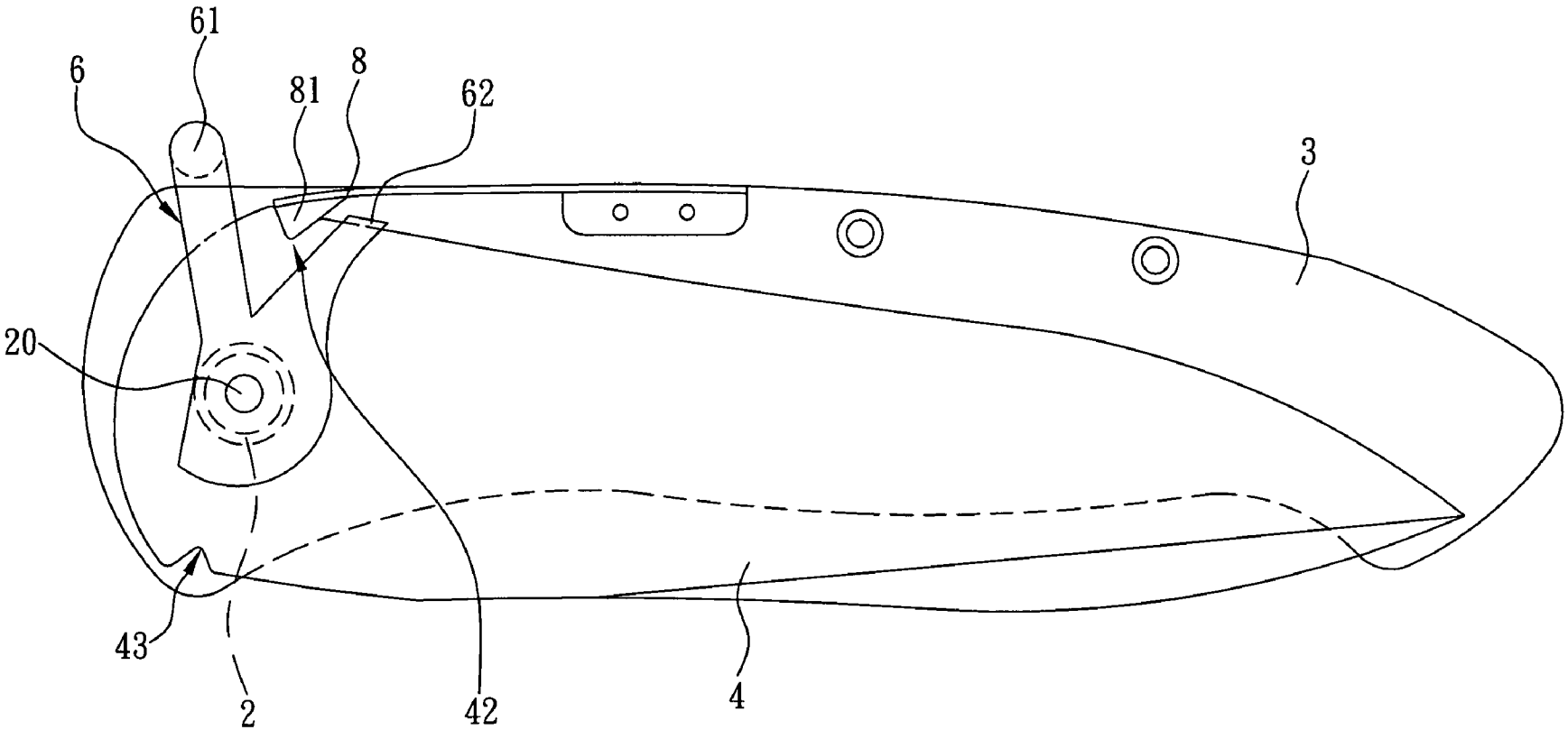
FIG. 8 is a cross-sectional view of a foldable knife according to a third preferred embodiment of the present invention in a status where a blade is received in a handle.
Figure 9:
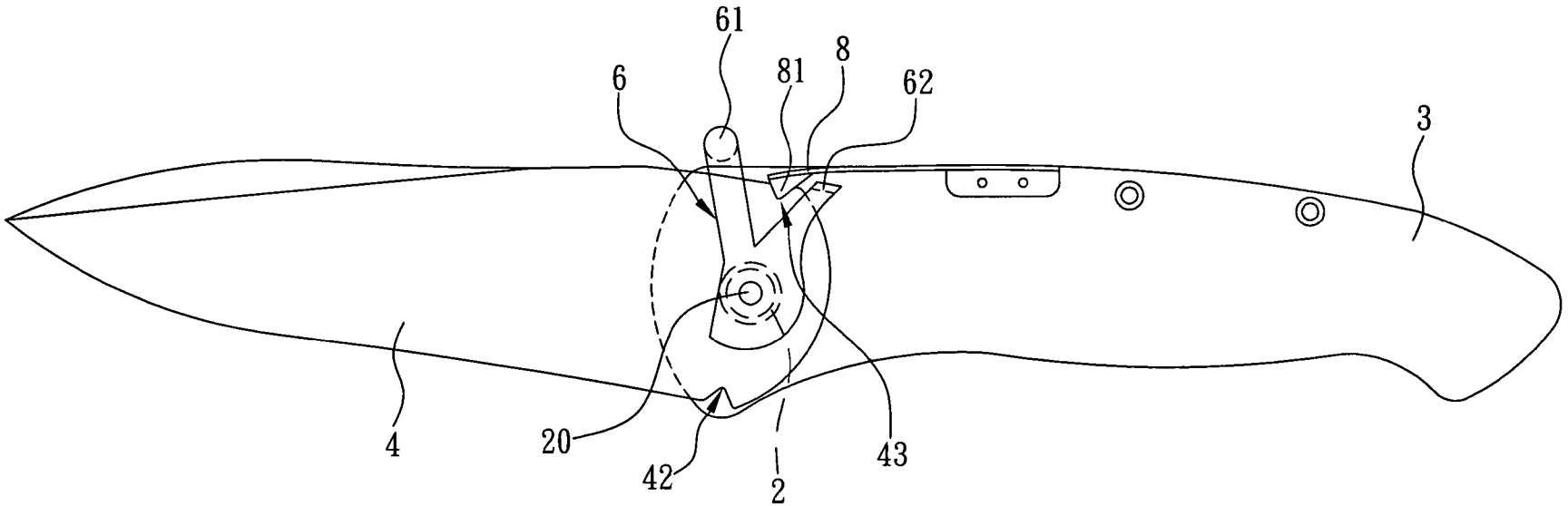
FIG. 9 is a cross-sectional view of the foldable knife according to the third preferred embodiment of the present invention in a status where the blade is released out of the handle.

Referring now to FIG. 8, in a third preferred embodiment of the present invention, the poking element 6 is pivotally connected to a pivot 20 where the handle 3 and the blade 4 are pivotally connected to each other. The poking element 6 has a first end extended out of the handle 3 and formed with a protruding poking portion 61 for being pushed by the user. The poking element 6 also has a second end formed with a pressing portion 62. Furthermore, the handle 3 has a back side edge which is formed with a blocking element 8 therein. The blocking element 8 is an elastic sheet structure, and has a side surface which is close to the blade 4 and formed with the positioning portion 81 (such as a protrusion). When the blade 4 is completely received in the handle 3, the blocking element 8 is tightly in contact with the blade 4 due to an elastic force of the blocking element 8. Thus, the positioning portion 81 of the blocking element 8 is engaged with an engaging portion 42 (such as a recess) formed on the blade 4, so that the blade 4 is stably received and positioned in the handle 3. Meanwhile, the pressing portion 62 bears against the blade 4, and is sandwiched between the blade 4 and the blocking element 8. When the user pushes the protruding poking portion 61, the pressing portion 62 is actuated to apply a force to the blocking element 8. When this force is enough to disengage the positioning portion 81 from the engaging portion 42, the torque of the torsion spring 2 will drive the blade 4 out of the handle 3. Referring to FIG. 9, when the blade 4 has sprung completely out of the handle 3, the blocking element 8 is tightly in contact with the blade 4 due to the elastic force of the blocking element 8, and the positioning portion 81 is engaged with another engaging portion 43 formed on the end of the blade 4, so as to prevent the blade 4 from being rotated and received in the handle 3. As a result, when the user wants to fold the blade 4 into the handle 3, the user only has to push the protruding poking portion 61 of the poking element 6 with a finger, so that the blocking element 8 is forced and moved away from an engaged position where the blocking element 8 is engaged with the blade 4. Thus, the blade 4 is released for being rotated, and can be pushed in the handle 3. Therefore, the user can hold the handle 3 firmly in one hand, and simultaneously use a finger of the same hand to push the protruding poking portion 61 of the poking element 6, so that the blade 4 will speedily and smoothly spring out of the handle 3. Similarly, when the user wants to fold the blade 4 into the handle 3, the user can do so by pushing the protruding poking portion 61 of the poking element 6 with a finger, and then pushing the blade 4 into the handle 3. As a result, the operational convenience and safety of the foldable knife are greatly enhanced.

Figure 10:
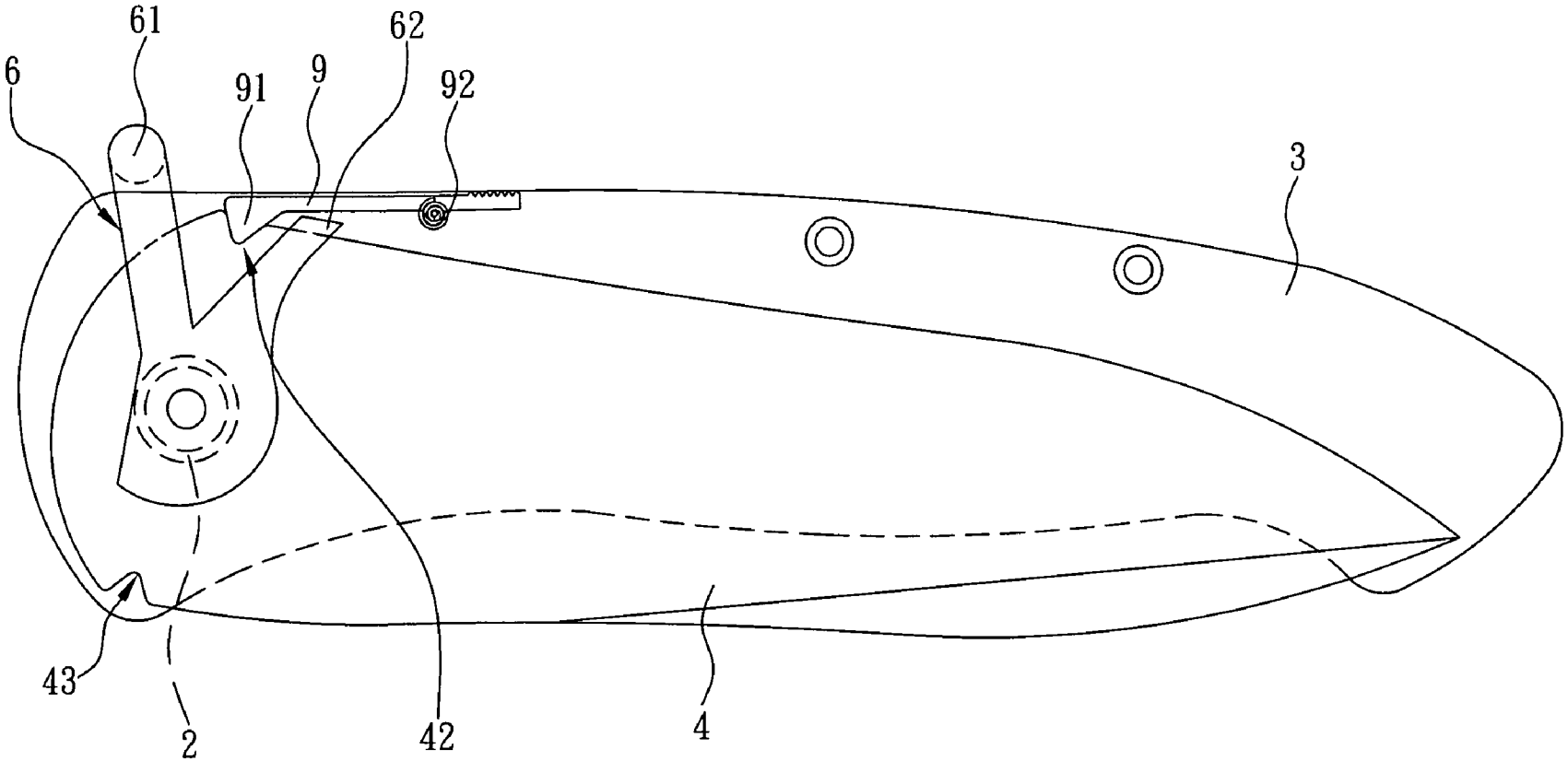
FIG. 10 is a cross-sectional view of a foldable knife according to a fourth preferred embodiment of the present invention in a status where a blade is received in a handle.

Referring now to FIG. 10, in a fourth preferred embodiment of the present invention, the handle 3 is provided with a blocking element 9 pivotally connected to an inner portion of the handle 3. The blocking element 9 is a rod-like structure, and has a side surface which is close to the blade 4 and formed with a positioning portion 91 (such as a protrusion). Furthermore, the handle 3 has a back side edge which is formed with an elastic member 92 therein. When the blade 4 is completely received in the handle 3, the blocking element 9 is tightly in contact with the blade 4 due to an elastic force of the elastic member 92. Meanwhile, the positioning portion 91 of the blocking element 9 is engaged with an engaging portion 42 (such as a recess) formed on the blade 4, so that the blade 4 is stably received and positioned in the handle 3. Meanwhile, the pressing portion 62 bears against the blade 4, and is sandwiched between the blade 4 and the blocking element 9. As a result, when the user pushes the poking element 6, the pressing portion 62 is actuated to apply a force to the blocking element 9, so as to disengage the positioning portion 91 from the engaging portion 42. Thus, the torsion spring 2 will drive the blade 4 to spring out of the handle 3. When the blade 4 has sprung completely out of the handle 3, the blocking element 9 is tightly in contact with the blade 4 due to an elastic force of the elastic member 92, so that the positioning portion 91 is engaged with another engaging portion 43 formed on the end of the blade 4, thereby preventing the blade 4 from being rotated and received in the handle 3. As a result, the user can hold the handle 3 firmly in one hand, and use a finger of the same hand to simultaneously push the protruding poking portion 61 of the poking element 6, so that the blade 4 can spring speedily and smoothly out of the handle 3, or be received in the handle 3. Thus, the operational convenience and safety of the foldable knife can be significantly improved.

As described above, in the traditional foldable knife, only when the blade 11 is forced to rotate out of the handle 10 to a predetermined angle will the elastic member 13 begin to generate an outward torque away from the handle 10 to drive the blade 11 to spring out of the handle 10. Contrarily, in the foldable knife of the present invention, the torsion spring 2 is used as an elastic member. When the blade 4 is completely received in the handle 3, the torsion spring 2 already has the torsional force to drive the blade 4 to spring out of the handle 3, allowing the blade 4 to spring out more easily and rapidly. Moreover, it is easy for a user to stably hold the handle 3 in one hand, and use a finger of the same hand to simultaneously push the protruding poking portion 61, so as to drive the blade 4 to spring rapidly out of the handle 3. If a particular condition or an emergent condition happens and the user only has one free hand to use, the user can conveniently and speedily operate the foldable knife.

The present invention has been described with preferred embodiments thereof and it is understood that many changes and modifications to the described embodiments can be carried out without departing from the scope and the spirit of the invention that is limited only by the appended claims.

What is claimed is:

1. A foldable knife, comprising:

a handle having a receiving space;

a blade having an end pivotally connected to an end of the handle by a pivot, wherein the blade can be rotated out of the handle or received in the receiving space of the handle in relation to the pivot, and a side surface of the blade is formed with an engaging portion;

a spring mounted on the pivot, wherein the spring has two ends connected to the handle and the blade respectively, so that the spring applies a torque to the blade to rotate the blade out of the handle;

a blocking element formed in the handle, wherein when the blade has sprung completely out of the handle, and an edge of the blocking element is engaged with an edge of the blade, so as to prevent the blade from being rotated and received in the handle; when the blocking element is forced and moved away from an engaged position where the edge of the blocking element is engaged with the edge of the blade, the blade is released for being rotated and can be completely received in the handle; and a side surface of the blocking element is formed with a positioning portion which is engaged with the engaging portion, when the blade is completely received in the handle, for allowing the blade to be stably received and positioned in the handle; and a poking element pivotally connected to an inside of the handle, wherein a first end of the poking element is extended out from the handle to a position outside a rotating range of the blade and is formed with a protruding poking portion, and a second end of the poking element is formed with a pressing portion which presses onto the blade when the blade is completely received in the handle, thereby, when the protruding poking portion is poked by a user, the pressing portion exerts a force to the blade to overcome an engagement force between the positioning portion and the engaging portion and in turn to enable the blade to be completely and automatically turned out from the handle by the torque of the spring.

2. The foldable knife of claim 1, wherein the poking element is pivotally connected to the pivot.

3. The foldable knife of claim 2, wherein the blocking element is provided at a second inner portion of the handle adjacent to the pivot, and is an elastic sheet, and the side surface of the blocking element is tightly in contact with the side surface of the blade due to an elastic force of the blocking element when the blade is completely received in the handle, so as to enable the engaging portion to be engaged with the positioning portion.

4. The foldable knife of claim 2, wherein the blocking element is an elastic sheet structure and formed in a back side edge of the handle, while the blocking element has a side surface which is close to the blade and formed with the positioning portion; and wherein:

when the blade is completely received in the handle, the blocking element is tightly in contact with the blade due to an elastic force of the blocking portion, so that the engaging element is engaged with the positioning portion;

when the protruding poking is pushed, the pressing portion applies a force to the blocking element to disengage the positioning portion from the engaging portion, so that the torque of the spring drives the blade to spring out of the handle; and when the blade has sprung completely out of the handle, the blocking element is engaged with another engaging portion formed on the end of the blade due to the elastic force of the blocking element, so as to prevent the blade from being rotated and received in the handle.

5. The foldable knife of claim 2, further comprising an elastic member formed in a back side edge of the handle, wherein the blocking element is a rod-like structure pivotally connected to an inner portion of the back side edge of the handle, and the blocking element has the side surface which is close to the blade and formed with the positioning portion; and wherein:

when the blade is completely received in the handle, the blocking element is tightly in contact with the blade due to an elastic force of the elastic member, so that the engaging portion is engaged with the positioning portion;

when the protruding poking portion is pushed, the pressing portion applies a force to the blocking element to disengage the positioning portion from the engaging portion, so that the torque of the spring drives the blade to spring out of the handle; and when the blade has sprung completely out of the handle, the blocking element is engaged with another engaging portion formed on the end of the blade due to the elastic force of the elastic member, so as to prevent the blade from being rotated and received in the handle.

6. The foldable knife of claim 1, wherein the poking element is pivotally connected to a first inner portion of the handle adjacent to the pivot.

7. The foldable knife of claim 6, wherein the blocking element is provided at a second inner portion of the handle adjacent to the pivot and is an elastic sheet: when the blade is completely received in the handle, and the side surface of the blocking element is tightly in contact with the side surface of the blade due to an elastic force of the blocking element when the blade is completely received in the handle, so as to enable the engaging portion to be engaged with the positioning portion.

8. The foldable knife of claim 6, wherein the blocking element is an elastic sheet structure and formed in a back side edge of the handle, while the blocking element has a side surface which is close to the blade and formed with the positioning portion; and wherein:

when the blade is completely received in the handle, the blocking element is tightly in contact with the blade due to an elastic force of the blocking element, so that the engaging portion is engaged with the positioning portion;

when the protruding poking portion is pushed, the pressing portion applies a force to the blocking element to disengage the positioning portion from the engaging portion, so that the torque of the spring drives the blade to spring out of the handle; and when the blade has sprung completely out of the handle, the blocking element is engaged with another engaging portion formed on the end of the blade due to the elastic force of the blocking element, so as to prevent the blade from being rotated and received in the handle.

9. The foldable knife of claim 6, further comprising an elastic member formed in a back side edge of the handle, wherein the blocking element is a rod-like structure pivotally connected to an inner portion of the back side edge of the handle, and the blocking element has the side surface which is close to the blade and formed with the positioning portion; and wherein:

when the blade is completely received in the handle, the blocking element is tightly in contact with the blade due to an elastic force of the elastic member, so that the engaging portion is engaged with the positioning portion;

when the protruding poking portion is pushed, the pressing portion applies a force to the blocking element to disengage the positioning portion from the engaging portion, so that the torque of the spring drives the blade to spring out of the handle; and when the blade has sprung completely out of the handle, the blocking element is engaged with another engaging portion formed on the end of the blade due to the elastic force of the elastic member, so as to prevent the blade from being rotated and received in the handle.

* * * * *